US009445676B2

(12) United States Patent
Ceballos Godefroy

(10) Patent No.: US 9,445,676 B2
(45) Date of Patent: Sep. 20, 2016

(54) FOLDABLE BASE FOR DISPLAY COUNTERS

(76) Inventor: Ricardo Ceballos Godefroy, Mexico City (MX)

( * ) Notice: Subject to any disclaimer, the term of this patent is extended or adjusted under 35 U.S.C. 154(b) by 0 days.

(21) Appl. No.: 14/118,447

(22) PCT Filed: May 17, 2012

(86) PCT No.: PCT/IB2012/000971

§ 371 (c)(1),
(2), (4) Date: Feb. 5, 2014

(87) PCT Pub. No.: WO2012/156810

PCT Pub. Date: Nov. 22, 2012

(65) Prior Publication Data

US 2014/0210326 A1 Jul. 31, 2014

(30) Foreign Application Priority Data

May 18, 2011 (MX) ..... MX/a/2011/005224

(51) Int. Cl.

| | |
|---|---|
| ***A47F 5/10*** | (2006.01) |
| *A47F 9/00* | (2006.01) |
| *A47F 5/00* | (2006.01) |

(52) U.S. Cl.

CPC .. *A47F 5/10* (2013.01); *A47F 9/00* (2013.01); *A47F 2005/0075* (2013.01)

(58) Field of Classification Search

CPC ..... A47F 5/10; A47F 9/00; A47F 2005/0075
USPC ..... 312/258, 244, 262, 263, 280; 108/115
See application file for complete search history.

(56) References Cited

U.S. PATENT DOCUMENTS

| | | | | |
|---|---|---|---|---|
| 4,417,774 | A | 11/1983 | Bevan et al. | |
| 5,315,935 | A * | 5/1994 | Weisenfels | 108/193 |
| 5,882,098 | A * | 3/1999 | Brown et al. | 312/258 |
| 6,039,419 | A * | 3/2000 | Brown et al. | 312/262 |
| 6,240,855 | B1 * | 6/2001 | Pirkl et al. | 108/115 |
| 6,412,424 | B1 * | 7/2002 | Dirks | 108/44 |
| 8,960,817 | B2 * | 2/2015 | Ceballos-Godefroy | 312/262 |

(Continued)

FOREIGN PATENT DOCUMENTS

WO WO 2011010212 A2 * 1/2011

OTHER PUBLICATIONS

International Search Report issued Dec. 10, 2012; re: PCT/IB2012/000971; pp. 2; citing US 2010314979 A1, Muebles Sabaia, U.S. Pat. No. 4,417,774 A.

(Continued)

*Primary Examiner* — Daniel J Troy
*Assistant Examiner* — Ryan A Doyle
(74) *Attorney, Agent, or Firm* — Cantor Colburn LLP

(57) ABSTRACT

A foldable base for a counter includes upright and folded position. The folding base includes a front panel; a first side panel hingedly connected thereto, the first side panel extending backwards from the front panel in the upright position; a spacer joined to the front panel; and a second side panel hingedly connected to the spacer. The second side panel is opposite the first side panel in the upright position. The counter further includes a cover mounted on the base in the upright position. In the folded position, one of the side panels is placed or housed behind the front panel, while the other side panel is placed over the side panel previously placed or housed in the front panel. The counter further includes a door hingedly connected to the first side panel.

7 Claims, 8 Drawing Sheets

(56) References Cited

U.S. PATENT DOCUMENTS

| | | | | |
|---|---|---|---|---|
| 2008/0012455 | A1* | 1/2008 | Zheng | 312/262 |
| 2009/0032349 | A1* | 2/2009 | Ceballos-Godefroy et al. | 190/103 |
| 2010/0314979 | A1* | 12/2010 | Ceballos-Godefroy | 312/244 |

OTHER PUBLICATIONS

Muebles Sabaia, Empresa dedicada a the yenta of muebles. Busqueda Nov. 26, 2012; <<ahref="http://www.sabaia.com/colec-cion-jardin/972-mesa-colonial-jardin-teka-redonda-2-alas-plegables.html>. pp. 1.

* cited by examiner

FOLDABLE BASE FOR DISPLAY COUNTERS

FIELD OF THE INVENTION

The present invention relates to techniques employed in the manufacture and design of furniture, showcases and counters that offer products and services and, in particular, the invention relates to a folding base for counters including only one front panel resulting in a reduction of the size of the base, the folding base also includes a cover that is mounted on the base.

BACKGROUND OF THE INVENTION

In many places where public gather for the acquisition and exposure of products and services, such as fairs, conventions, information centers and so on, there is a need to use furniture and counters approach the public to the suppliers and present their products to them. In this regard, there is an important variety of such furniture, e.g. wooden-made, metallic, furnished with shelves, partitions; in general terms, though, they are bulky, difficult to handle and transport thereof results in hardships since they take up a lot of space.

One art-known solution to such problems has involved the creation of carton folding furniture and counters; nevertheless, their structural rigidity is poor and, furthermore, it is not convenient placing heavy things thereon. In addition, this type of carton-made furniture lacks of an outstanding aesthetical appearance, which is an important factor to achieve a commercial impact of the product or service being supplied.

There also exists furniture with countless panels, rods and posts that are coupled each to the other; however, assembly thereof is time-consuming and the pieces to be assembled are too many.

Despite the above, there are counters that have been broadly accepted and which are practical to use for such purposes, among them there are those counters that contain a base and a cover mounted on the base and a board assembled on at least one post that is inserted in the cover. In this type of counters, the board has the purpose of identifying the name of the supplier or the product being offered while the supplier is located behind the counter to attend to the customers approaching the counter.

One of such counters is disclosed in Mexican patent No. 212,227, whose most significant advantage is that the counter elements can be disassembled and stored in the form of a briefcase, in which the cover forms a case of said briefcase and the base is housed within; at the same time the other pieces of the counter are also housed in the base.

The counter of the above-mentioned patent was restructured in Mexican patent No. 225,710, wherein the most significant changes are the inclusion of 45° cuttings between the post sections that support the board and a second shelf that runs on a rail, in addition a support to secure the post sections within the second shelf was included. In spite of such modification, the board is still unstable since it sways over the cover. Furthermore, the shelves frequently fall off their horizontal position because at their free side ends the shelves are secured only by pressure between the side panels of the base.

In international patent application No. PCT/IB2005/002083, there are disclosed a series of modifications to the counter of Mexican patent No. 225,710, and such modifications relate to the inclusion of means for supporting shelves firmly so that they do not move, either that the counter is in a upright position or folded.

In this type of counters, the cover is an independent piece that must be manipulated to mount it on the base; the cover also serves as a house for the base once folded, which may become complicated for some people, apart from the fact that it takes time to do these operations.

As it may be observed, the base of the counters of the previous art has a substantial role, since it is the part that supports all the weight, and products to offer are placed on it. Another function of the base is that the base is a housing in which the other pieces of the counter are stored, and furthermore, it is preferably foldable so that it takes little space when the counter is disassembled.

In International patent No. PCT/IB2010/001767; it is disclosed a foldable base for this kind of counter, the base includes a pair of doors and a cover connected to one of the side panels, however this base, as the other bases of the prior art, comprises a pair of front panels, making the counter voluminous, that is to say many pieces are required for its fabrication.

In addition, it is important taking into consideration the fact that, in the market, there is a need for counters less voluminous, nevertheless nowadays there is not a base for counters with only one front panel, in which the other pieces of the counter may be housed.

Therefore, there is a need for satisfying certain particular requirements of the counter market related with bases with a reduced volume but being yet foldable, the base allowing the other elements to be housed therein.

SUMMARY OF THE INVENTION

In accordance to the aforementioned, the purpose herein has been to overcome the drawbacks of the bases for counters on which a cover is mounted, and above the last a board, developing a base comprising only one front panel; a first side panel hingedly connected to the front panel, the first side panel extending backwards from the front panel in the "upright" position of the base; which also comprises a spacer joined to the front panel, another element of the base is a second side panel hingedly connected to the spacer, the second panel being opposite to the first side panel in the "upright" position of the base.

In the "folded" position of the base, the first side panel is placed behind the front panel, while the second side panel is placed, with the aid of the spacer, over the first side panel previously placed in the front panel.

In a preferred embodiment of the invention, the base also comprises a door hingedly connected to one of the side panels in order to close the base at the rear part thereof. It is worth mentioning that in the folded position of the base, the door is housed inside the side panel to which the door is connected.

The cover may be a separated element of the base or may be hingedly connected to one of the side panels. When the cover is joined to one of the side panels the connection is done by hinge means, so that the cover is folded next to the side panel to which the cover is hingedly connected.

Inasmuch as the base is used in counters, the cover is provided with at least one hole in which a post is received; the post supporting a board, which may be housed in one of the side panels or in the door In another embodiment, the base further comprises a pair of wheels mounted on at least one of the side panels.

In an additional embodiment, the base comprises an upper shelf and a lower shelf, both of them being mounted between the side panels. The shelves may be separated elements of the base or may be mounted inside the base.

When the shelves are mounted to the base; the upper shelf is hingedly connected to one of the side panels, likewise the lower shelf is hingedly connected to one of the side panels.

In another aspect of the invention, it is provided a counter comprising a base; a cover that is mounted on the base; at least one post that is inserted in the cover and a board that is coupled to the post. Preferably, the post is inserted into the cover in order to be received in one of the side panels of the base.

BRIEF DESCRIPTION OF THE DRAWINGS

Novel aspects featured by the present invention shall be set forth in connection with the appended claims. Nevertheless, the invention itself shall be better understood regarding its structure, as well as other objects and advantages of the same, with the following detailed description of a preferred embodiment thereof, when read in conjunction with the appended figures, in which:

DETAILED DESCRIPTION OF A PREFERRED EMBODIMENT OF THE INVENTION

Figure 1:
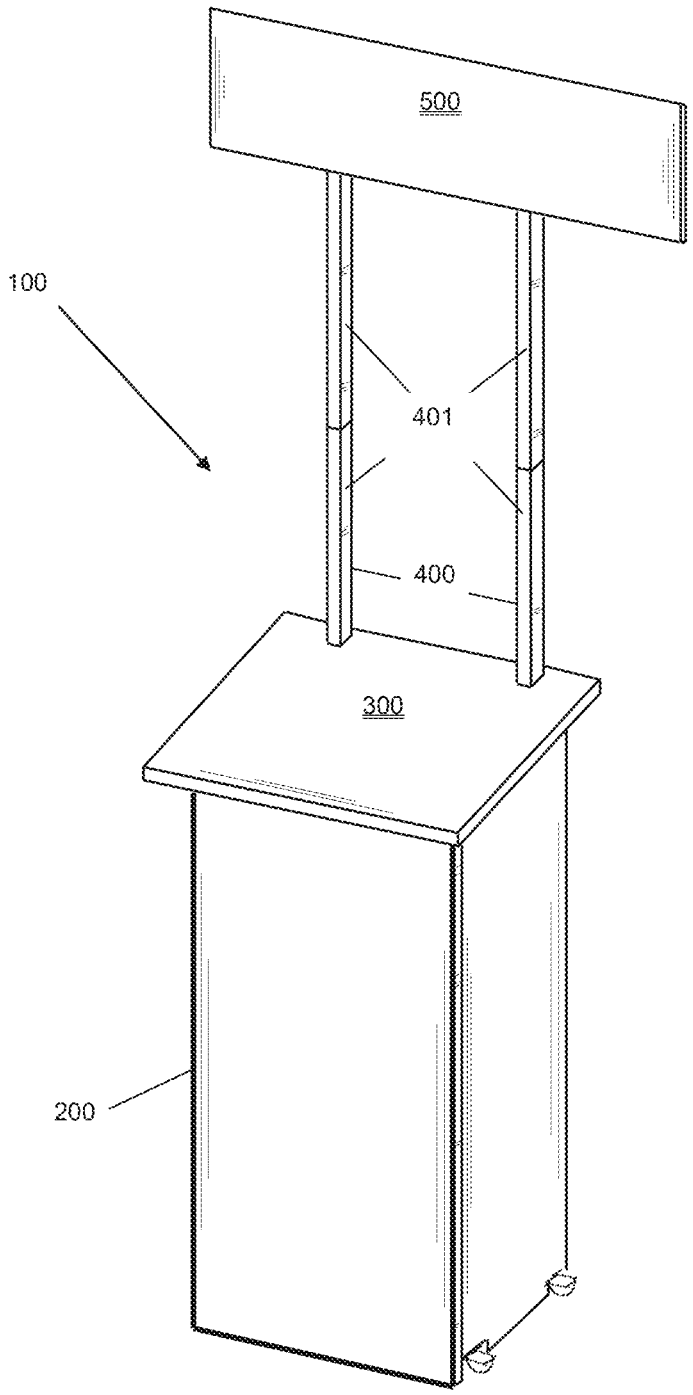
FIG. 1 is a frontal and upper perspective view of a counter with a base built in accordance to a preferred embodiment of the present invention.

With reference to the accompanying drawings and more specifically, to FIG. 1 thereof, it is shown a counter 100 comprising a base 200; a cover 300 which is mounted on the base 200; a pair of posts 400 that are inserted in the cover 300 and are supporting a board 500 vertically separated from the base 200. The posts 400 are formed by a pair of sections 401, upper and lower, which couple with each other. The board 500 may also be supported by a single post and even, each post 400 may be done in a single piece. The counter 100 of FIG. 1 is a typical example where the base of the present invention may be used, which is described as follows in its preferred embodiment.

Figure 2:
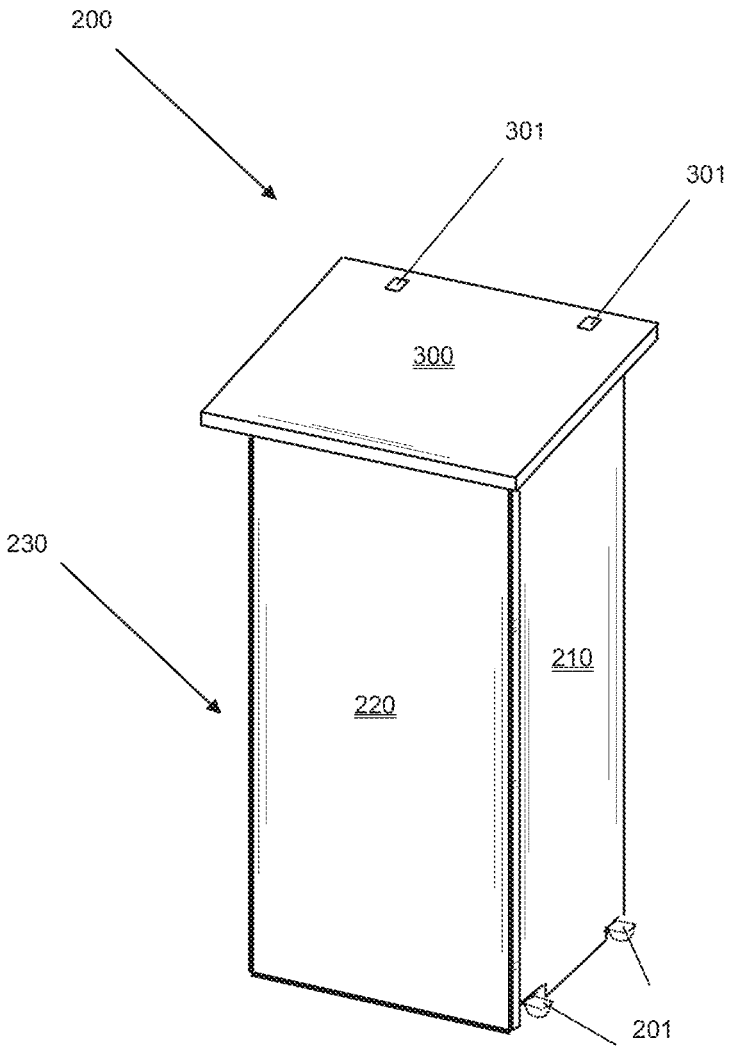
FIG. 2 is an upper perspective view of a base for counters built in accordance with the preferred embodiment of the present invention.

So, reference is made to FIG. 2 which shows the base 200 in its "upright" position, which includes a first side panel 210; a single front panel 220 hingedly connected to the first side panel 210; and a second side panel 230 that is opposite to the first side panel 210. As it can be observed, the fact of providing just one single front panel 220 means a significant structural change resulting in a reducing volume of the base with respect to the bases of the prior art.

Over the base 200, there is a cover 300 placed, which is provided with a couple of holes 301, where the posts supporting the board are inserted, and which were illustrated in FIG. 1. In the present invention, it is possible that the cover 300 only has one hole 301 for those boards supported only by one post. Likewise, posts may cross the cover in order to be inserted in the side panels to make a stronger mounting among the post and the side panels.

In the lower part of the base 200, there is a pair of wheels 201 mounted at the lower part of the first side panel 210, in a similar way, in the lower part of the second side panel 230, there is another pair of wheels that, in FIG. 2, cannot be seen. The wheels 201 make it easier to move all the base 200 from one side to another, mainly when, within it, there are products, and particularly when the base is in its upright position as shown in FIG. 2.

Figure 3A:
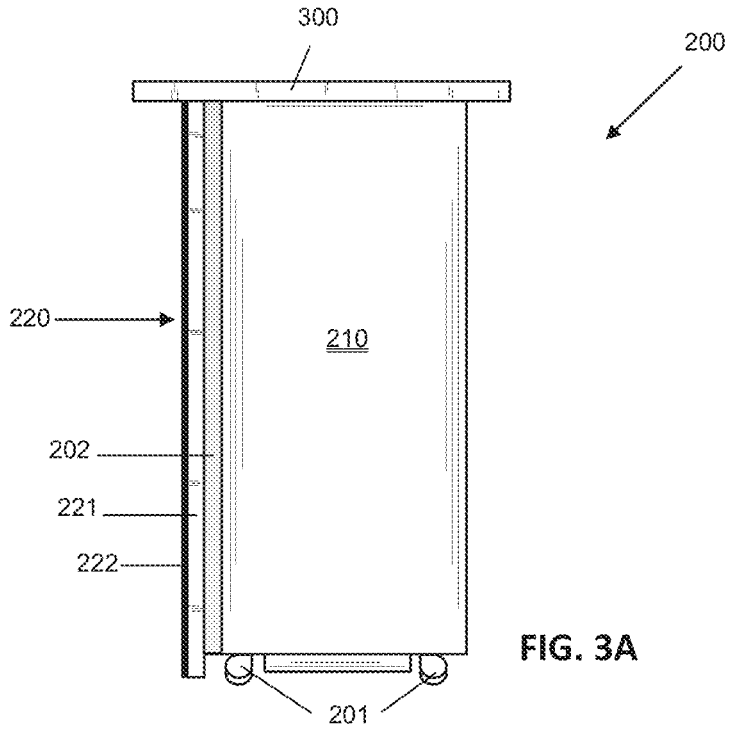
FIG. 3A is a left side view of the base shown in FIG. 2.

FIG. 3A shows a left side view of the base 200 supported on the wheels 201 according to the embodiment that is currently disclosed, where it can be observed, the first side panel 210 hingedly connected to the front panel 220 by means of a plastic hinge 202 running up downward and externally over the first side panel 210.

In the embodiment that is disclosed, the front panel 220 is preferably formed by a frame 221 of rectangular shape on which there is a plate 222 joined. In this sense, it is worth mentioning that the first side panel 210 is formed in a similar manner, that is to say, it comprises a frame 211 on which there is a plate 212 mounted.

Figure 3B:
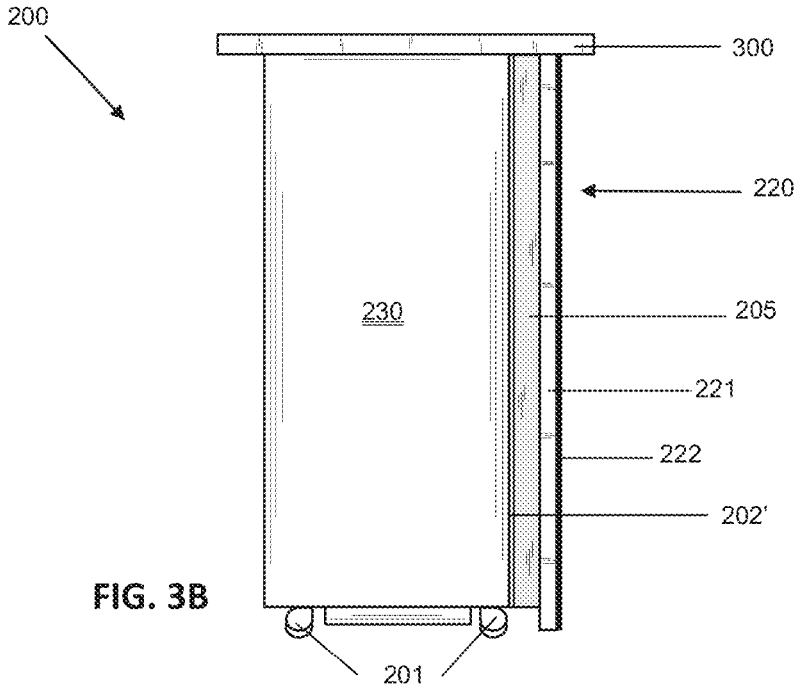
FIG. 3B is a right side view of the base shown in FIG. 2

Now, reference is made to FIG. 3B that illustrates a right side view of the base 200 with another pair of wheels mounted to the second side panel 230 that is connected to the front panel 200 by means of a spacer 205, that is preferably rigid made of metals as aluminum or may be a plastic plate. More particularly, the second side panel 230 is hingedly connected to the spacer 205 by means of a hinge 202' placed between the spacer 205 and one of the sides of the second side panel 230. In FIG. 3B, there are also illustrated the frame 221 and the plate 222 that form the front panel 220. The second side panel 230 is formed in a similar manner, that is to say, the second side panel comprises a frame 231 on which a plate 232 is mounted.

It is convenient highlight that the relationship among frames and plates for the sides panels 210 and 230, as well as that for the front panel 220 is preferred in the instant invention, however the same may be fabricated in a single one piece from thermoformable polymers, from another point of view the point is the structural relationship among such panels of the base.

Now, with respect to the spacer 205, the same has an important role in the base, as its own name indicates the spacer allows the second side panel 230 to be separated from the front panel 220 in order that the second panel may be placed on the first side panel once the base is folded.

The plastic hinges 202 and 202' may be substituted with other type of hinges such as metal, piano-type hinges in order to achieve the structural connection required for the side panels, the spacer and the front panel of the base of the instant invention.

Figure 4:
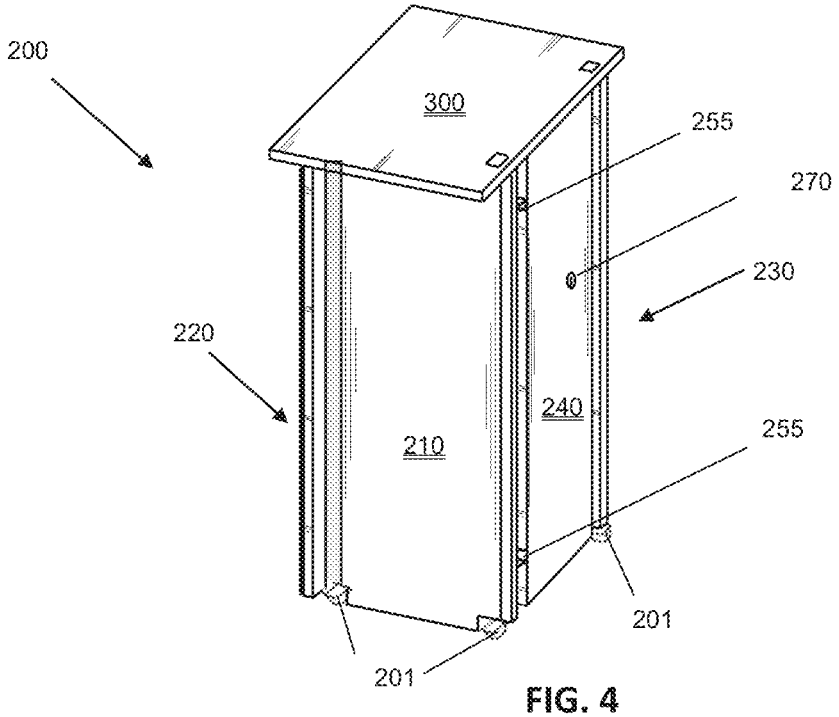
FIG. 4 is a rear and upper perspective view of the base for counters of FIG. 2.
Figure 5:
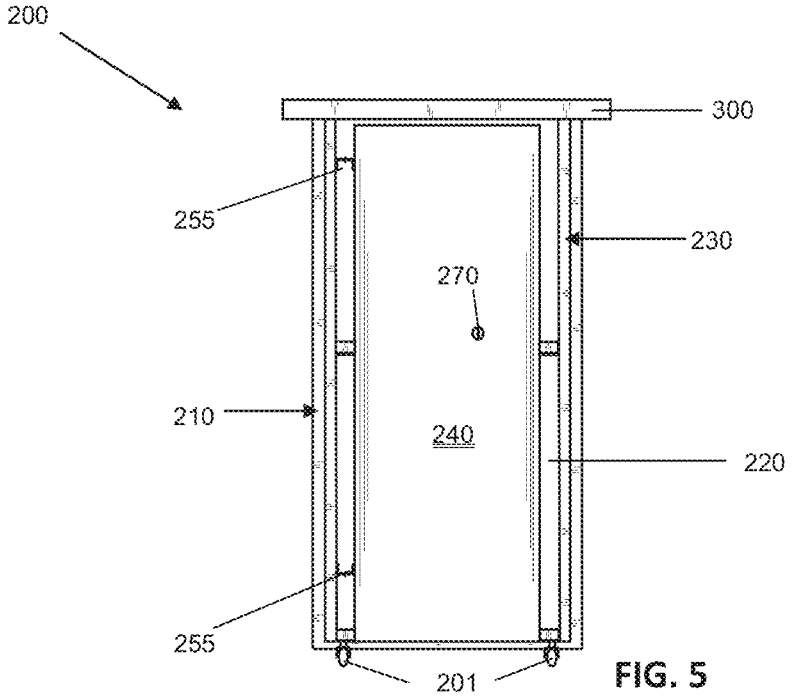
FIG. 5 is a rear view of the base illustrated in FIG. 2 with its door closed.

Now, reference is made to FIGS. 4 and 5 to show some characteristic elements of the base 200 of the embodiment described in here, and as observed, the base comprises a door 240 hingedly connected to the first side panel 210 by means of a pair of metal hinges 255 vertically separated one with respect to the other. These FIGS. 4 and 5 show that the base 200 rests on the wheels 201, with which it may be moved easily from one place to another in the upright position, where the side panels 210 and 230 are opposite to each other, and the front panel 220 is opposite to the door 240 and the cover 300 covers the base it its upper part. The door 240 allows having access and control on the products that are placed inside the base 200 on which the cover 300 is placed. The door 240 may be locked to the inside of the base using the lock 270 or other locking means may be used as keyholes, pins, etc., to restrict access to the inside part of the base 200.

Figure 6:
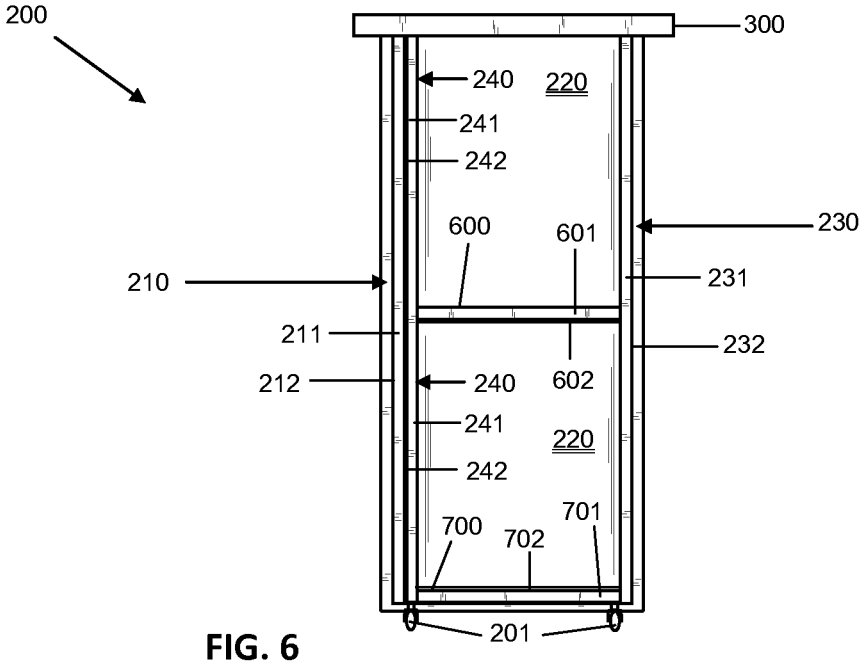
FIG. 6 is a rear view of the base shown in FIG. 5 with its door open.

Going to FIG. 6, it shows the base 200 with its door 240 open in a parallel position with respect to side panels 210 and 230, the door 240 is formed by a frame 241 which preferably has a rectangular shape, on which a plate 242 is joined. In a preferred embodiment, the door 240 has a smaller size than the first side panel in order to be housed inside it, and so reduce the size of the base 200 once it is folded. The door 240 has a wide movement, more than 270°, to be able to move both inside and outside of the base, and to place it inside of the first side panels 210 when the base 200 gets folded.

Inside the base 200, there is an upper shelf 600 and a lower shelf 700 mounted between the side panels 210 and 230, of them, the upper shelf 600 is formed by a frame 601 which has a plate 602 attached, said frame 601 is oriented upward. The upper shelf 600 is mounted in a hingedly mode to the frame 211 of the first side panel 210, in order be housed therein.

On the other hand, the lower shelf 700 is formed by a frame 701 and a plate 702 joined on such frame, the lower shelf is hingedly connected to the lower side of the frame 231 of the second side panel in such a way that, when lifting said lower shelf, the same is housed in the second side panel 230, as shown in the teachings of the afore mentioned international application No. PCT/IB2005/002083. The connection of the lower shelf with the frame 231 is done with a piano-type hinge.

Now, in a preferred embodiment, the shelves 600 and 700 are elements separated of base 200 and they may be mounted on supports provided in the frames 211 and 231 of the side panels 210 and 230. At this point, it is convenient to mention that the shelves 600 and 700 are optional elements of the base of the present invention, but they are illustrated in the mode described to give evidence on the advantages and flexibility of the present invention. Furthermore, the shelves may be such that the upper shelf 600 is connected to any of the side panels 210 or 230.

Another important characteristic of the embodiment of the base 200 described in here, is related to the cover 300, which is hingedly connected to the second side panel by hinge means, in such a way that it may be taken from a horizontal position to a vertical position in order to be folded.

Figure 7:
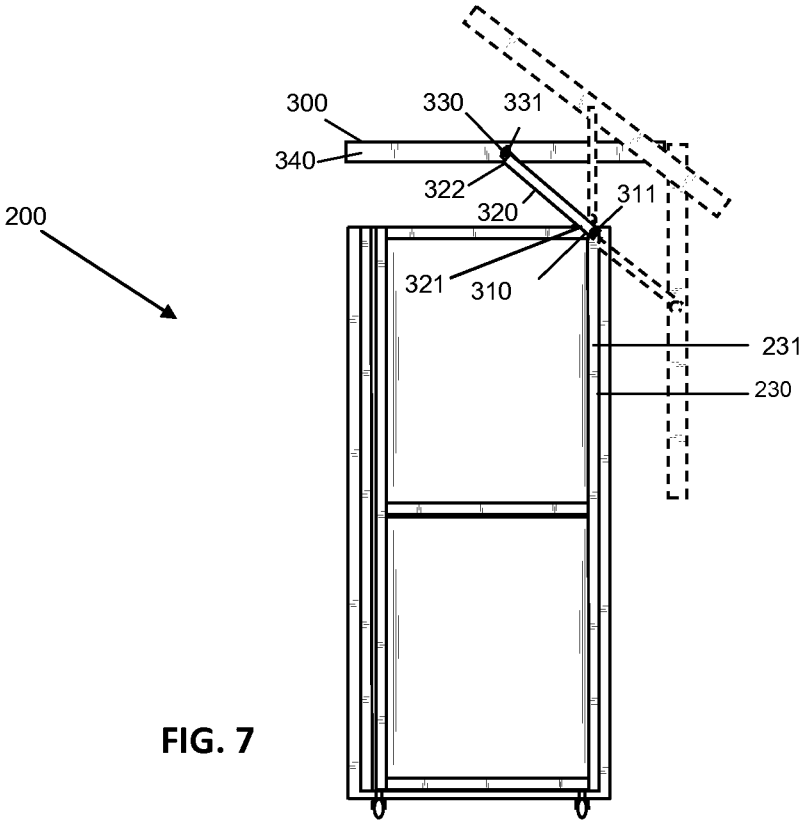
FIG. 7 is a rear view of the base illustrated in FIG. 6, in which the movement sequence to fold the cover is shown.
Figure 8:
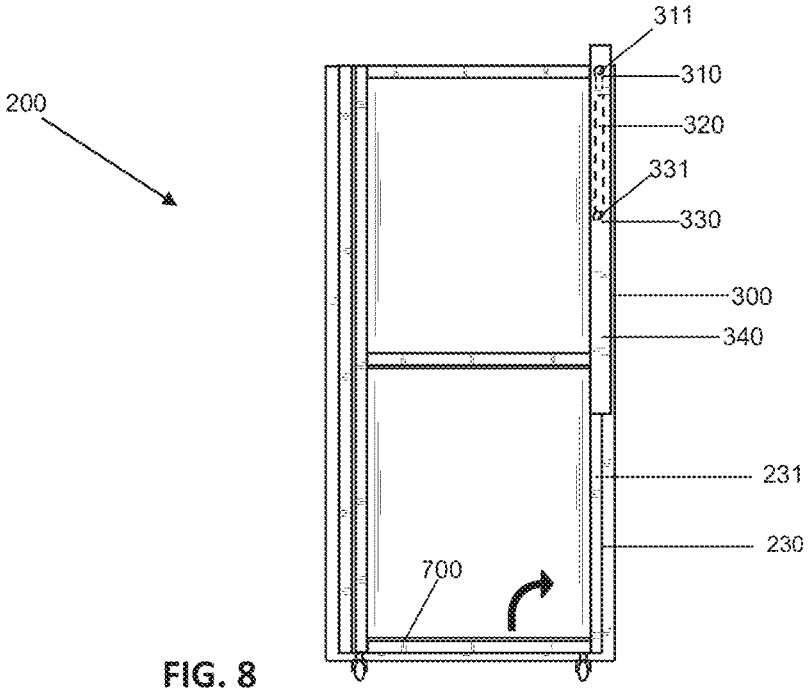
FIG. 8 is a rear view of the base illustrated in FIG. 6, in which the cover is already folded.

In order to explain this characteristic, reference is made to FIGS. 7 and 8, where it may be observed that in the embodiment describe in here, hinge means include a lower rotary base 310 mounted over the second side panel 230, particularly over the frame 231, the lower rotary base 310 includes a rotation axis 311; another piece of this connection is an arm 320 which has a lower end 321 and an upper end 322, of which the lower end 321 is crossed by the rotation axis 311 of the lower base 310, while the upper end 322 is crossed by the rotation axis 331 of an upper rotary base 330 which is mounted and hidden under the cover 300.

The cover 300 has a rectangular shape with a perimeter wall 340 with a height enough in order to hide the arm 320, as well as the rotary bases 310 and 330 when the base 200 is either standing-up or folded. Other hinge means may be used for this connection between the cover with one of the side panels, said hinge means may be a moving frame as a replacement of arm, or an arm-shock absorber, etc.; what is important is that the arm 320 allows to connect the cover 300 to one of the side panels 210 or 230 and take it from a substantially horizontal position up to a substantially vertical position, in order to make easier the assembly or disassembly of the cover 300 on base 200.

Finally, on the other hand, FIG. 8 illustrates the ascending rotation movement that follows the lower shelf 700 in order to be housed inside the second side panel 230 that is partially hidden by the cover 300.

Figure 9:
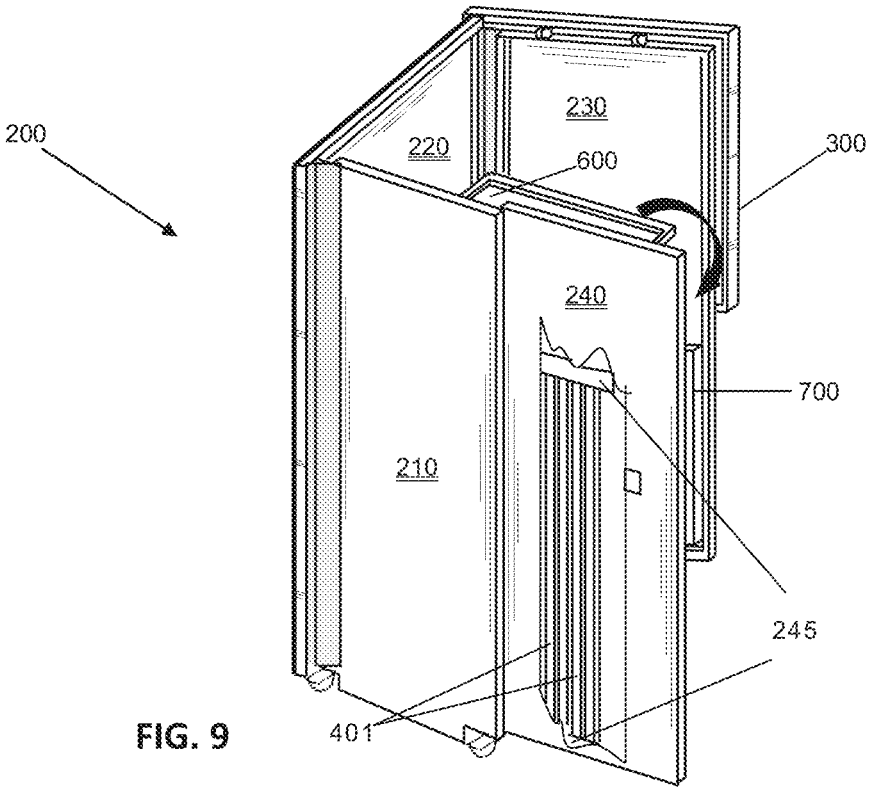
FIG. 9 is an upper perspective view of the base illustrated in FIG. 8 which shows the movement to fold the upper shelf.

With the aid of FIGS. 9 to 14, a description will be given of the way in which base 200 is taken up to its folded position. In FIG. 9, the base has its door 240 open, the door includes in its inner face supports 245 vertically separated once with respect to the other, in said supports the sections 401 of the posts may be stored, posts support a board over the base.

In FIG. 9, at the external side of the second side panel 230, there is the cover 300 in its vertical position. On the other hand, FIG. 9 also illustrate the lower shelf 700 already housed in the second side panel 230. On the other hand, the upper shelf 600 is rotated downwardly to be housed in the first side panel 210 in the position illustrated in FIG. 10. In turn, over the lower shelf 700 already housed, the board (illustrated in FIG. 1) may be placed in order to be also housed in the first side panel, these features are illustrated in international patent application No. PCT/IB2005/002083.

Figure 10:
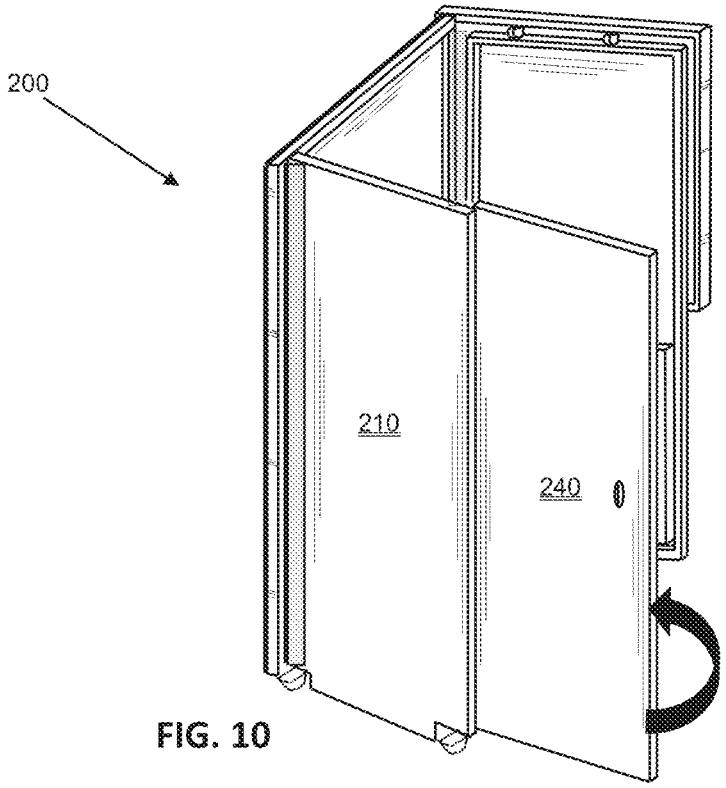
FIG. 10 is an upper perspective view of the base illustrated in FIG. 9 which shows the movement to house the door.
Figure 11:
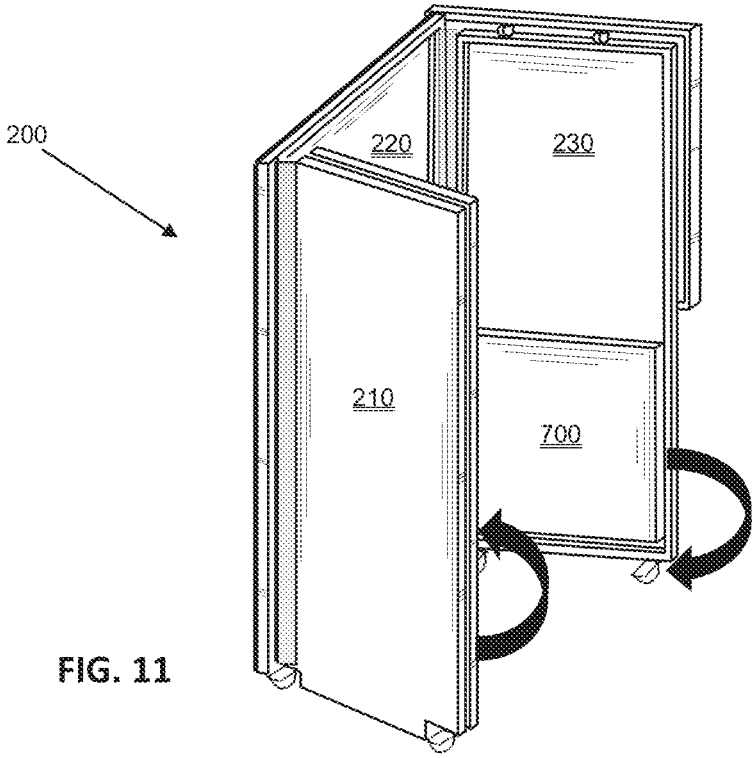
FIG. 11 is an upper and frontal perspective view of the base illustrated in FIG. 10 which shows the movement to fold the side panels.
Figure 12:
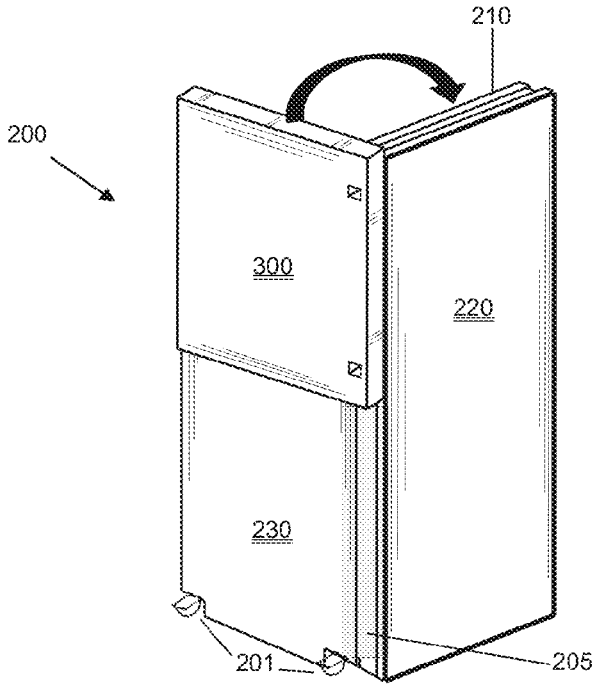
FIG. 12 is a front and upper perspective view of the base illustrated in FIG. 11 which shows the final movement to fold the base.

As shown in FIG. 10, the door 240 is turned 180° to place it next to the first side panel 210 covering the upper lower shelf (already housed) until reaching the position shown in FIG. 11; from which, it is possible to see that, in order to continuing folding the base 200, the first side panel 230 is turned about 90° to the inside of the base to be placed on the rear part of the front panel 220 and the second side panel 230 is also turned 90° supported on the spacer 205 in order to reach the position of FIG. 12 in such a way that, at the end of this movement, there are two halves.

Figure 13:
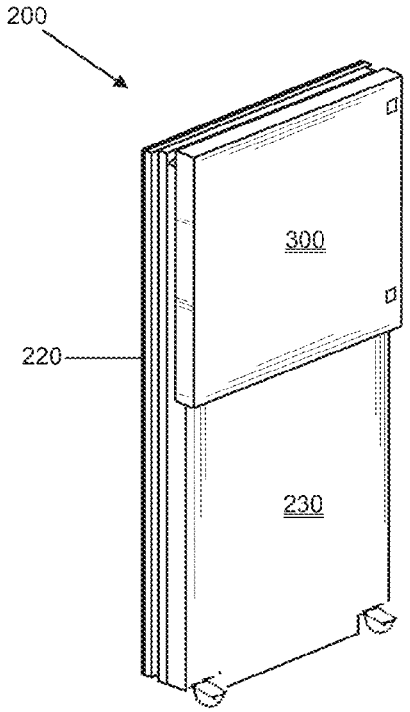
FIG. 13 is an upper perspective view of the base illustrated in FIG. 12 completely folded.
Figure 14:
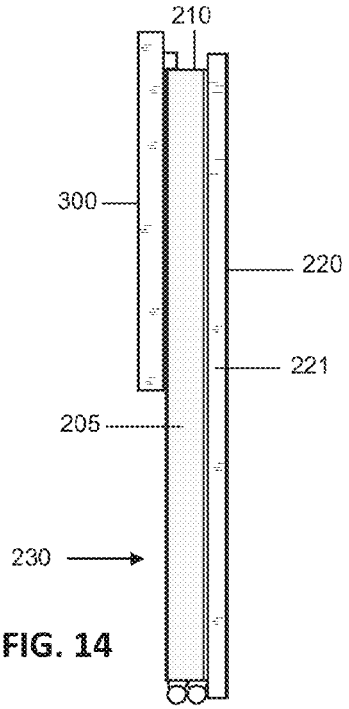
FIG. 14 is a right side view of the base illustrated in FIG. 13.
Figure 15:
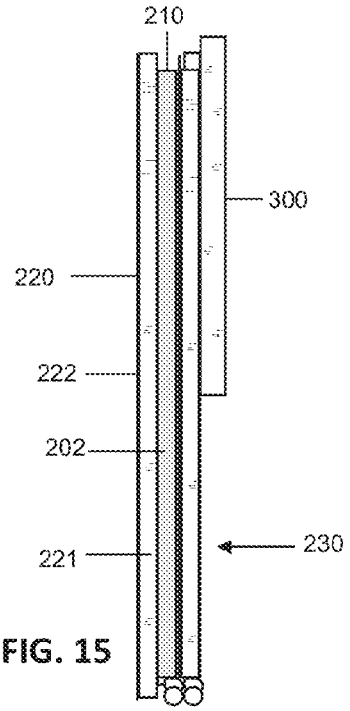
FIG. 15 is a left side view of the base illustrated in FIG. 13.

Subsequently, as it is shown in FIG. 12, the second side panel 230 is turned to the inside of the base in order to be placed on the first side panel 210 already placed on the rear part of the front panel, so that the base reaches its folded position, as illustrated in FIGS. 13, 14, and 15.

FIGS. 13, 14 and 15 show the folded position of the base 200, which is extremely compact, in this position the door is housed in the first side panel, and the first side panel 210 is placed at the rear part of the front panel 220, and the second side panel is located over the first side panel 210; the cover 300 is placed to one side of the second side panel 230.

FIG. 14 shows how the spacer 205 allows the second side panel 230 to be placed at one side of the first side panel 210; in a similar manner, in FIG. 15 it can be observed the plastic hinge 203 by which connection is made between the front panel 220 and the first side panel 210.

The base 200 in its folded position is supported by the wheels 201, with which the base in this position may move from one place to another very easily.

It is preferred that materials with which the most important elements of the base are made; this is, the side panels, the front panel, door, shelves and the cover; the material are light-weight materials such as polymers, preferably polyvinyl chloride (PVC), although they may be manufactured with other materials, such as wood, cardboard, etc.

Even when a preferred embodiment of the invention has been described and exemplified, it should be stressed that several modifications of it are possible, such as the choice of placing shelves inside the base or mount one, two or more posts to support a board; another option is that side panels and the front panels are made of just one single piece. Therefore, this invention should not be considered as limited except for what it is required by the prior art and by the scope of the appended claims.

REFERENCE LIST

100 Counter
200 Base
201 Wheels
202 Plastic hinge
202' Plastic hinge
205 Spacer
210 First side Panel
211 Frame of the first side panel
212 Plate of the first side panel
220 Front panel
221 Frame of the front panel
222 Plate of the front panel
230 Second side panel
231 Frame of the second side panel
232 Plate of the second side panel
240 Door
241 Frame of the door
242 Plate of the door
245 Supports
255 Pair of metal hinges
270 Lock
300 Cover
301 Holes
310 Lower rotary base
311 Rotation axis of the lower base
320 Arm
321 Lower end of the arm
322 Upper end of the arm
330 Upper rotary base
331 Rotation axis of the upper base
340 Perimeter wall
400 Posts
401 Sections of the posts that may be connected
500 Board
600 Upper shelf
601 Frame of the upper shelf
602 Plate of the upper shelf
700 Lower shelf
701 Frame of the lower shelf
702 Plate of the lower shelf

What is claim is:

1. A counter comprising:

a folding base having an "upright" position and a "folded" position, the folding base comprising:
- a front panel;
- a first side panel hingedly connected to the front panel, the first side panel extending backwards from the front panel in the "upright" position of the base;
- a spacer joined to the front panel;
- a second side panel hingedly connected to the spacer, the second side panel being opposite to the first side panel in the "upright" position of the folding base;

a cover hingedly connected to the second side panel by hinge means, wherein the cover is provided with at least one hole;

an upper shelf hingedly connected to the first side panel;

a lower shelf hingedly connected to the second side panel;

at least one post that is inserted in the cover to be received in one of the first side panel and the second side panel;

a board coupled to the post; and a door hingedly connected to the first side panel;

wherein in the "folded" position of the folding base the lower shelf is housed in the second side panel while the upper shelf is housed in the first side panel, the door is housed inside the first side panel, while the first side panel is placed behind the front panel, while the second side panel is placed over the first side panel locating the first side panel between the front panel and the second side panel; and the cover is exteriorly folded next to the second side panel.

2. The counters according to claim 1, wherein the hinge means comprises:

a lower rotary base mounted on the second side panel to which the cover is mounted, the lower rotary base including a rotation axis;

an arm which has a lower end and an upper end; and an upper rotary base which is mounted under the cover and including a rotation axis;

wherein the lower end is crossed by the rotation axis of the lower rotary base, while the upper end is crossed by the rotation axis of the upper rotary base.

3. The counter according to claim 1, wherein the spacer is rigid.

4. The counter, according to claim 1, wherein the post comprises a lower section and an upper section that are coupled each to the other.

5. The counter, according to claim 4, further comprising a support, where the door has an inner face in which said support is mounted, each of the sections of the post being stored in said support.

6. The counter, according to claim 1, further comprising a pair of wheels mounted on at least one of the side panels.

7. The counter, according to claim 1, wherein each of the front panels, the first side panel, the second side panel, and the cover, is formed in one single piece made from thermoformable polymers.

* * * * *